US005233716A

United States Patent [19]

Hicks

[11] Patent Number: 5,233,716

[45] Date of Patent: Aug. 10, 1993

[54] MULTIPURPOSE RIGGING TOOL

[75] Inventor: Douglas C. Hicks, Lewes, Del.

[73] Assignee: CHPT Incorporated, Lewes, Del.

[21] Appl. No.: 775,470

[22] Filed: Oct. 15, 1991

[51] Int. Cl.[5] ..... B25F 1/00

[52] U.S. Cl. ..... 7/165; 7/170

[58] Field of Search ..... 7/165, 167, 170; 24/115 R, 115 H, 115 K, 129 R; 81/44; D3/61, 62, 63, 64

[56] References Cited

U.S. PATENT DOCUMENTS

| | | | |
|---|---|---|---|
| 851,351 | 4/1907 | Hanley | 81/44 |
| 2,481,304 | 9/1949 | Frevel | 81/44 |
| 3,742,533 | 7/1973 | Brunette | 7/165 |
| 3,816,863 | 6/1974 | Thielemann | 7/165 |
| 4,700,500 | 10/1987 | Slappey, Jr. | 81/44 |
| 5,020,192 | 6/1991 | Gerlach | 24/115 R |
| 5,077,850 | 1/1992 | Brubaker | 7/165 |

*Primary Examiner*—Roscoe V. Parker
*Attorney, Agent, or Firm*—Connolly & Hutz

[57] ABSTRACT

A rigging tool has an integral rope tensioning handle, a push pin depressing stud, a key-chain ring, and a screwdriver. The tool is bar shaped with a pair of holes for having a rigging line laced therethrough.

16 Claims, 1 Drawing Sheet

MULTIPURPOSE RIGGING TOOL

FIELD OF INVENTION

The present invention relates generally to rigging tools, and more particularly to windsurfing. The present invention is compact, wear resistant, can serve most of the rigging requirements for setting-up a windsurfer and is suitable for mass production at low cost by several methods of manufacture.

BACKGROUND OF THE INVENTION

Rigging of modern windsurfing boards and sails requires the use of three separate tools. A screw driver is needed to install the fin into the fin box and to fasten the foot straps onto the deck of the board. Many of the booms in use today rely on a series of holes in the tubes comprising the boom and extension tubes, with push pins to hold them into position. This arrangement allows for adjustment of the boom length to accommodate the different widths of the sails used to handle the range of wind speeds encountered and requirements of a particular sailor. Many of the mast bases rely on push pins to lock onto the mast or mast extension. To facilitate depressing the push pins a small punch, stud, or other narrow blunt instrument is often used; especially when sand, dirt or corrosion has entered into the mechanism. Many of the sails in use today require substantial down-haul tension to bend the mast and give the sail the proper shape for efficient operation. Similarly, many sails require a substantial amount of outhaul tension. To achieve this degree of downhaul and/or outhaul tension, the windsurfing equipment manufacturers have added two and three part blocks to the mast bases and boom rear ends. To fit this number of turns on the blocks and tack and/or clew of the sail necessitates using small diameter ($<\frac{1}{4}''$) line. This small line is difficult to hold directly in hand when exerting the 20+ pounds of force required to tension the down-haul and/or out-haul. To increase the amount of force applied by hand, sailors often use an extra boom extension tube to tie into line to give them something to grip when tensioning the line.

There is a commercially available downhaul and outhaul rigging tool referred to as "Easy-Rig". The "Easy-Rig" is comprised of a jam cleat molded into the form of a plastic handle. Although the "Easy-Rig" does work as an effective line gripping tool, the nature of the design makes it susceptible to rapid wear of the teeth in the jam cleat. This wear is worsened when the sand and grit normally found in and on the line begins to abrade the gripping surfaces of the teeth.

There is a commercially available push pin tool called the "Boom Button". This device is a plastic sleeve with a stud mounted on it that can be used to depress the push pins when adjusting the boom. The sleeves are slipped onto the booms (one on each side) and must be left there until the booms are disassembled.

It goes without saying that screwdrivers are commercially available for use in installing the windsurfer fins and foot straps. At present, the sailor is required to carry around three separate tools to perform to job of rigging a windsurfer. In addition, when using a boom extension or the like as the rigging tool, the line must be knotted properly so it can be removed after tensioning. Often during rigging the downhaul line must be retied further along the line as the sail is brought down closer to the block. For those less skilled in seamanship this repetitive knot tying can be bothersome. The "Easy-Rig" is effective when new but the limited working lifetime of the gripping mechanism results in its being thrown away or used simply as an instrument to tie the line to rather than grip it in the worn jam cleat.

SUMMARY OF THE INVENTION

An object of this invention is to provide a very simple alternative to the set of tools normally employed for rigging a windsurfer.

The device of the invention combines all three tools into one compact and easily manufactured device. A novel technique for gripping the downhaul and out-haul lines is utilized that does not require the user to tie knots, and is much less prone to failure in the sandy beach environment. Additionally the rigging tool can also function as a key-chain holders.

THE DRAWINGS

DETAILED DESCRIPTION

Figure 1:
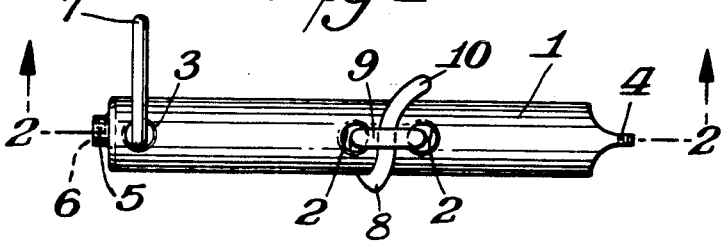
FIG. 1 is a top plan view of a rigging tool according to the present invention.
Figure 4:
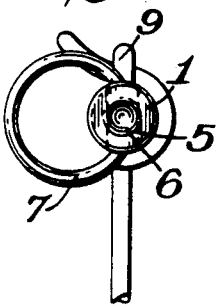
FIGS. 3–4 are end views of the rigging tool depicted in FIG. 1.
Figure 2:
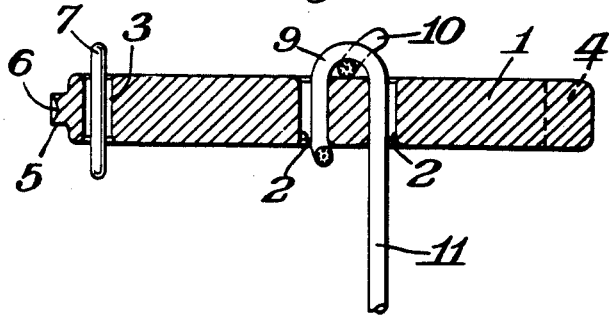
FIG. 2 is a cross-sectional view of the rigging tool shown in FIG. 1 taken along the line 2—2.
Figure 3:
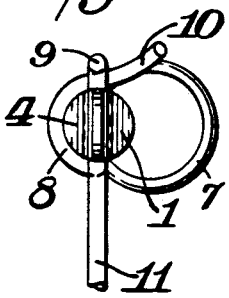

FIG. 1 illustrates a cylindrical bar 1 through which two holes 2 have been drilled perpendicular to the axis of and positioned approximately near the middle of the bar. Shown passing through the pair of holes 2 is the line 11 from, for example, the sail downhaul on a windsurfer. A third hole 3 has been drilled perpendicular to the axis and near one end of the bar 1 and is shown with a keychain ring 7 mounted through it. Integral to and at opposite ends of the bar 1 in FIG. 1 are a screwdriver blade 4 and a raised stud 5 with a hemispherical indentation 6. The screwdriver 4 and stud 5 can be used during the course of rigging the windsurfer as needed to install the fin or footstraps and actuate the push pins. The keychain ring 7 can be used optionally for keys or as an attachment point for securing the rigging tool to, for example, the windsurfer.

The method for gripping the line 11 with the bar 1 can be seen in the drawings. The line 11 is first passed up through one hole 2 and back down through the second hole 2, brought up along the side of the bar at position 8 and then passed under the loop of line 11 formed between the pair of holes 2 at position 9. Once tension is applied to the line 11 by gripping and pulling on the bar 1, the loop 9 will press down on the free end 10 on line 11, thereby preventing it from slipping. If the bar needs to be positioned further up along line 11 during the course of rigging the sail or removed when rigging is complete, free end 10 can be pulled upwards which will loosen the loop 9 allowing the line to be moved through the holes 2.

In the one preferred embodiment, the entire device would be constructed by machining a solid elongated cylindrical bar of metal such as aluminum, stainless steel, brass, bronze, or titanium. A surface treatment such as anodizing for the aluminum could be applied to increase the wear and corrosion resistance of the device. An alternative embodiment would have the device cast from a metal using techniques such as die or investment casting. A further alternative embodiment would have the device molded from an engineering polymer such as acetal, nylon, polycarbonate, ABS, polyurethane, polystyrene, that may or may not be reinforced with fibers such as glass, carbon, graphite. Depending on the strength of the material used to construct the device, inserts may be advantageously used to form the screwdriver and/or push pin stud, and/or to stiffen and strengthen the bar.

The overall size of the device is not critical. A small version, roughly four inches in length and ½" in diameter, would serve as a reasonable handle for tensioning the line but still be compact enough to function as a keychain fob. For individuals requiring a more substantial handle, the device could be increased in size accordingly. An eight inch length with a ⅝ inch diameter would permit two-handed operation. The size and spacing of the rope holes 2 can be varied to suit the particular application. Experience has shown that a pair of 0.25" diameter holes spaced ½" apart on centers serves the majority of windsurfing lines used. To reduce the chance of chaffing the lines, the holes 2 should be chamfered or radiused to smooth the edges.

Thus, while the present invention has been described above with respect to the exemplary embodiment thereof, it will be understood by those of ordinary skill in the art that variations and modifications can be effected within the scope and spirit of the invention.

What is claimed is:

1. In a rigging tool incorporating a mechanism for gripping lines, the improvement being in that said tool further includes a push pin driver in the form of a stud having a depression, and said tool further including a key chain ring whereby said tool functions as a multipurpose tool.

2. A rigging tool as claimed in claim 1 wherein said tool further includes a screwdriver.

3. A rigging tool as claimed in claim 2 wherein said tool is bar shaped and utilizes a pair of holes running perpendicular to the axis of said bar whereby the line to be gripped can be laced up through one of said holes and down through the second of said holes and up along the side of said bar and under the loop of line formed between said two holes.

4. A rigging tool as claimed in claim 3 wherein said tool is made from a metal selected from the group consisting of aluminum, stainless steel, brass, bronze and titanium.

5. In a rigging tool incorporating a mechanism for gripping lines, the improvement being in that said tool further includes a push pin driver whereby said tool functions as a multipurpose tool, said tool further including a screwdriver, said tool being bar shaped and utilizing a pair of holes running perpendicular to the axis of said bar whereby the line to be gripped can be laced up through one of said holes and down through the second of said holes and up along the side of said bar and under the loop of line formed between said two holes, and said tool being constructed from an engineering polymer selected from the group consisting of acetal, nylon, polycarbonate, ABS, polyurethane, and polystyrene.

6. A rigging tool as claimed in claim 5 wherein said tool is reinforced with fibers selected from the group consisting of glass, carbon, and graphite.

7. A rigging tool as claimed in claim 6 including a metal insert to form said screwdriver.

8. A rigging tool as claimed in claim 6 including a metal insert to form said push pin driver.

9. A rigging tool as claimed in claim 3 wherein said screwdriver is formed at one end of said tool, said push pin driver being formed at the opposite end of said tool, and said push pin driver having a hemispherical depression.

10. A rigging tool as claimed in claim 4 including a metal insert to form said screwdriver.

11. In a rigging tool incorporating a mechanism for gripping lines, the improvement being in that said tool is in the shape of an elongated bar having a longitudinal axis, a pair of generally parallel holes extending completely through said bar generally perpendicular to said axis, said holes being adapted to have a line laced through one of said holes and down through the other of said holes and up along the side of said bar and under the loop of line formed between said holes, and said tool further including a key chain ring.

12. A rigging tool as claimed in claim 11 wherein said bar is a solid cylinder.

13. A rigging tool as claimed in claim 12 wherein said tool is made from a metal selected from the group consisting of aluminum, stainless steel, brass, bronze and titanium.

14. A rigging tool as claimed in claim 11, in combination with a rigging line laced through said holes.

15. In a rigging tool incorporating a mechanism for gripping lines, the improvement being in that said tool is in the shape of an elongated bar having a longitudinal axis, a pair of generally parallel holes extending completely through said bar generally perpendicular to said axis, said holes being adapted to have a line laced through one of said holes and down through the other of said holes and up along the side of said bar and under the loop of line formed between said holes, and said tool is constructed from an engineering polymer selected from the group consisting of acetal, nylon, polycarbonate, ABS, polyurethane, and polystyrene.

16. A rigging tool as claimed in claim 15 wherein said tool is reinforced with fibers selected from the group consisting of glass, carbon, and graphite.

* * * * *